United States Patent [19]

Kaloi

[11] 3,947,850

[45] Mar. 30, 1976

[54] NOTCH FED ELECTRIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[22] Filed: Apr. 24, 1975

[21] Appl. No.: 571,153

[52] U.S. Cl. ..... 343/795; 343/822; 343/846

[51] Int. Cl.[2] ..... H01Q 1/38; H01Q 9/28

[58] Field of Search ..... 343/708, 769, 795, 822, 343/846

[56] References Cited

UNITED STATES PATENTS 3,810,183 5/1974 Krutsinger et al. ..... 343/708

FOREIGN PATENTS OR APPLICATIONS 1,050,583 1/1954 France ..... 343/708

*Primary Examiner*—Eli Lieberman

*Attorney, Agent, or Firm*—Richard S. Sciascia; J. M. St.Amand

[57] ABSTRACT

A notch fed electric microstrip dipole antenna consisting of a thin electrically conducting, rectangular-shaped element formed on one surface of a dielectric substrate, the ground plane being on the opposite surface. The length of the element determines the resonant frequency. The feed point is located in a notch along the centerline of the antenna length and the input impedance can be varied by moving the feed point along the centerline of the antenna without affecting the radiation pattern. Of all the many types of microstrip antennas built to date, this antenna offers the best advantages as far as arraying of the elements are concerned. The notched antenna can be arrayed using microstrip interconnecting transmission lines. The corner losses in the clad material and the width of the notch determines how narrow the element can be made. The purpose of the notch feed system is to interconnect any array of elements at the elements' optimum feed point using microstrip transmission lines.

12 Claims, 15 Drawing Figures

XY PLANE PLOT
2187 MHz Eø

XZ PLANE PLOT
2187 MHz Eθ

XY PLANE PLOT
2218 MHz Eø

XZ PLANE PLOT
2218 MHz Eθ

NOTCH FED ELECTRIC MICROSTRIP DIPOLE ANTENNA

This invention is related to copending U.S. patent applications:

Ser. No. 571,154 for DIAGONALLY FED MICROSTRIP DIPOLE ANTENNA;

Ser. No. 571,156 for END FED MICROSTRIP QUADRUPOLE ANTENNA;

Ser. No. 571,155 for COUPLED FED MICROSTRIP DIPOLE ANTENNA;

Ser. No. 571,152 for CORNER FED MICROSTRIP DIPOLE ANTENNA;

Ser. No. 571,157 for OFFSET FED MICROSTRIP DIPOLE ANTENNA;

Ser. No. 571,158 for ASYMMETRICALLY FED ELECTRIC MICROSTRIP DIPOLE ANTENNA;

all filed together herewith on Apr. 24, 1975 by Cyril M. Kaloi.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Other type antennas could not be flush mounted on a missile or airfoil surface. Slot type antennas required more cavity space, and standard dipole or monopole antennas could not be flush mounted.

SUMMARY OF THE INVENTION

The present antenna is one of a family of new microstrip antennas and uses a very thin laminated structure which can readily be mounted on flat or curved irregular structures, presenting low physical profile where minimum aerodynamic drag is required. The specific type of microstrip antenna described herein is the "notch fed electric microstrip dipole." This antenna can be arrayed with interconnecting microstrip feed lines as part of the element. Therefore, the antenna element and the feed lines can be photo-etched simultaneously. Using this technique, only one coaxial to microstrip adapter is required to interconnect an array with a transmitter or receiver. In addition, this antenna can be easily matched to most practical impedances by varying the location of the feed point along the length of the element. Of all the many types of microstrip antennas built to date, this antenna offers the best advantages as far as arraying of the elements are concerned. Reference is made to the "electric microstrip dipole" instead of simply the "microstrip dipole" to differentiate between two basic types; the first being the electric microstrip type, and the second being the magnetic microstrip type. The notch fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately ½ wavelength. The width may be varied depending on the desired electrical characteristics. The conducting ground plane is usually much greater in length and width than the radiating element.

The magnetic microstrip antenna's physical properties are essentially the same as the electric microstrip antenna, except the radiating element is approximately ¼ the wavelength and also one end of the element is grounded to the ground plane.

The thickness of the dielectric substrate in both the electric and magnetic microstrip antenna should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (e.g., a microstrip/monopole mode) above 25 GHz for most commonly used stripline materials. However, for clad materials thinner than 0.031 inch, higher frequencies can be used. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile. In the present antenna, the antenna element is not grounded to the ground plane. The antenna is easily matched to most practical impedances by varying the location of the feed point along the length of the element.

Advantages of the antenna of this invention over other similar appearing types of microstrip antennas is that the present antenna can be fed very easily from the ground plane side and has a slightly wider bandwidth for the same form factor.

The notch fed electric microstrip dipole antenna consists of a thin, electrically-conducting, rectangular-shaped element formed on the surface of a dielectric substrate. The element has a notch extending from one end thereof along the centerline of the length. The ground plane is on the opposite surface of the dielectric substrate and the microstrip antenna element is fed from a coaxial to-microstrip adapter, with the center pin of the adapter extending through the ground plane and dielectric substrate to the antenna element. The length of the antenna element determines the resonant frequency. The feedpoint is located along the centerline of the antenna length. While the input impedance will vary as the feed point is moved along the centerline between the antenna center point and the end of the antenna in either direction, the radiation pattern will not be affected by moving the feed point. The antenna bandwidth increases with the width of the element and the spacing (i.e., thickness of dielectric) between the ground plane and the element; the spacing has a somewhat greater effect on the band-width than the element width. The radiation pattern changes very little within the bandwith of operation.

The copper losses in the clad material and the width of the notch determines how narrow the element can be made. The notch feed system allows interconnection of any array of elements at the optimum feed point of each element, using microstrip transmission lines.

Design equations sufficiently accurate to specify the important design properties of the asymmetrically fed electric dipole antenna are also included below. These design properties are the input impedance, the gain, the bandwidth, the efficiency, the polarization, the radiation pattern, and the antenna element dimensions as a function of the frequency. Calculations have been made using these equations, and typical notched fed electric microstrip dipole antennas have been built using the calculated results. The design equations for this type antenna and the antennas themselves are new.

DESCRIPTION AND OPERATION

Figure 1A:
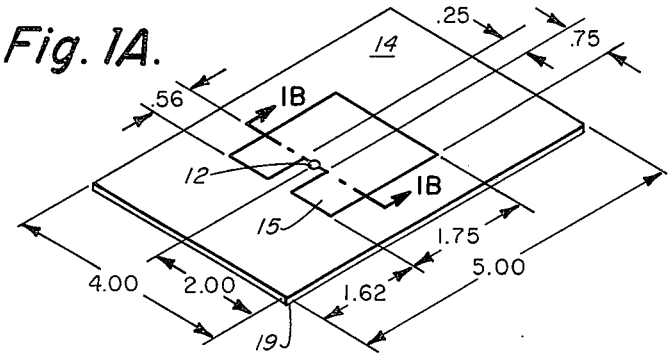
FIG. 1A is an isometric planar view of a typical square notch fed electric microstrip dipole antenna.
Figure 1B:
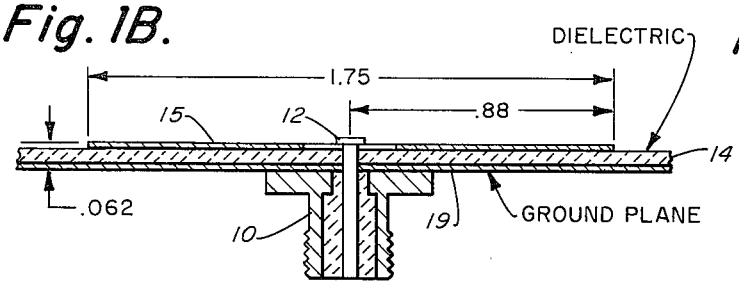
FIG. 1B is a cross-sectional view taken along section line B—B of FIG. 1A.
Figure 2A:
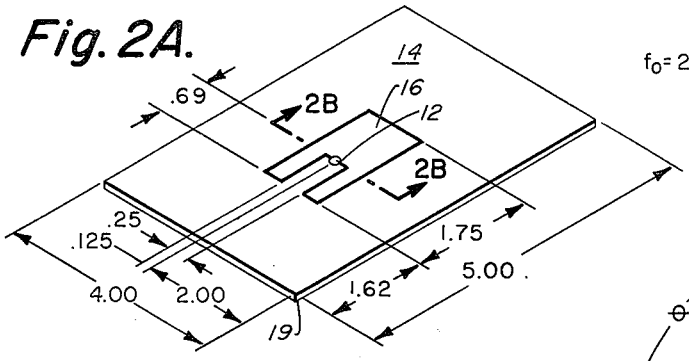
FIG. 2A is an isometric planar view of a typical rectangular notch fed electric microstrip dipole antenna.
Figure 2B:
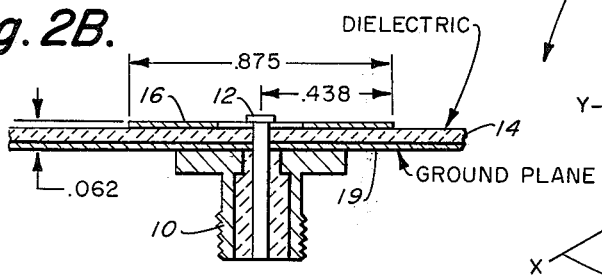
FIG. 2B is a cross-sectional view taken along section line B—B of FIG. 2A.
Figure 3A:
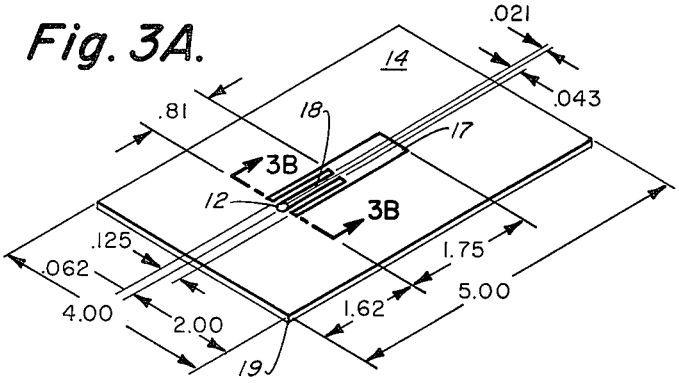
FIG. 3 shows a typical rectangular notch fed electric microstrip dipole antenna where the coaxial-to-mircrostrip adapter is at a location other than the optimum feed point and a microstrip feed line is used to connect the optimum feed point to the center pin of the adapter.
Figure 3B:
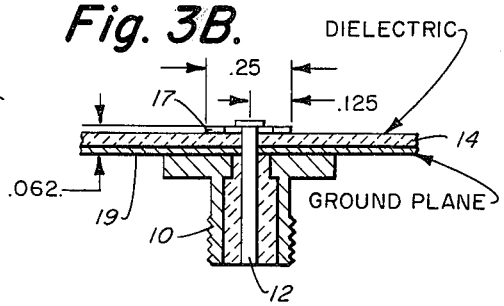

FIGS. 1A and 1B show a typical square notch fed electric microstrip dipole antenna of the present invention. FIGS. 2A and 2B show a rectangular notch fed electric microstrip dipole antenna. The only physical differences in the above antennas are the element width and notch length (i.e., the location of the feed point). The electrical difference is that the wider antenna element has a slightly greater bandwidth. Two typical antennas are illustrated with the dimensions given in inches, as shown in FIGS. 1A and 1B, and 2A and 2B, by way of example, and curves shown in later figures are for the typical antennas illustrated. The antenna is fed from a coaxial-to-microstrip adapter 10, with the center pin 12 of the adapter extending through the dielectric substrate 14 and to the feed point on microstrip element 15 or 16. If it is desired to have the coaxial-to-microstrip adapter at a location other than the optimum feed point (e.g., at the end), a microstrip feed line 18 can be used to bridge this gap between the optimum feed point and the center pin 12 of the adapter, as shown by way of example in the configuration of FIGS. 3A and 3B. The microstrip antenna can be fed with most of the different types of coaxial-to-microstrip launchers presently available. The dielectric substrate 14 separates the element 15, 16 or 17 from the ground plane 19 electrically.

Figure 4:
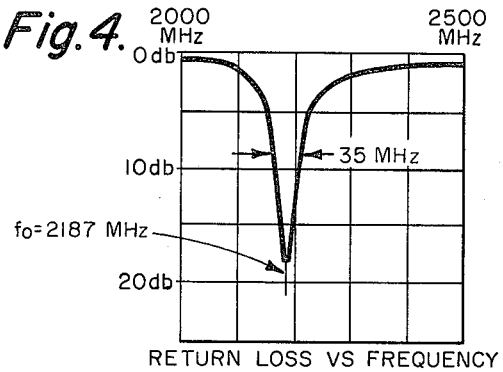
FIG. 4 is a plot showing the return loss versus frequency for a square element antenna having the dimensions shown in FIGS. 1A and 1B.
Figure 5:
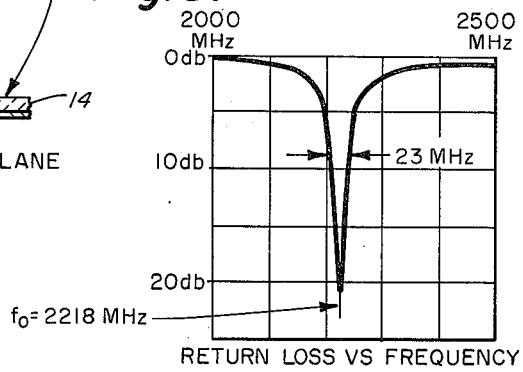
FIG. 5 is a plot showing the return loss versus frequency for a rectangular element antenna having the dimensions as shown in FIGS. 2A and 2B.

FIGS. 4 and 5 show plots of return loss versus frequency (which are indications of bandwidth) for the square element 15 and rectangular element 16, respectively. The square type element is the limit as to how wide the element can be without exciting higher order modes of radiation. With a square element, as in FIGS. 1A and 1B, mode degeneracy may occur if the feed point is not located at the center of the width. The result of mode degeneracy is undesired polarization. The copper losses in the clad material and the width of the notch determine how narrow the element can be made. The length of the element determines the resonant frequency of the antenna, about which more will be mentioned later. It is preferred that both the length and the width of the ground plane be at least one wavelength ($\lambda$) in dimension beyond each edge of the element to minimize backlobe radiation.

Figure 6:
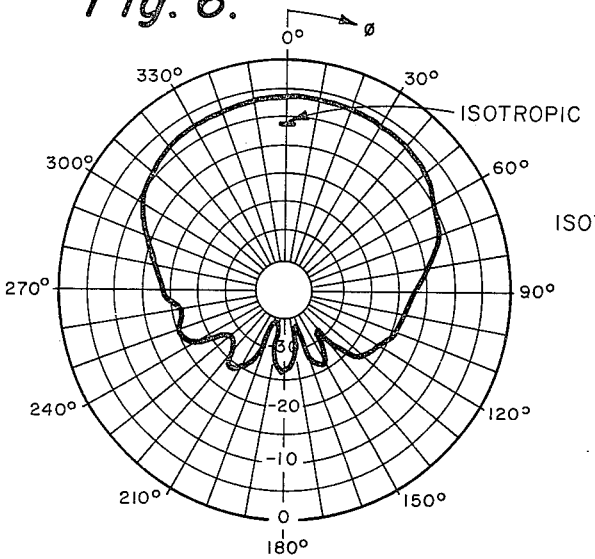
FIG. 6 shows the antenna radiation pattern (XY—-Plane plot) for the square element antenna shown in FIGS. 1A and 1B.
Figure 7:
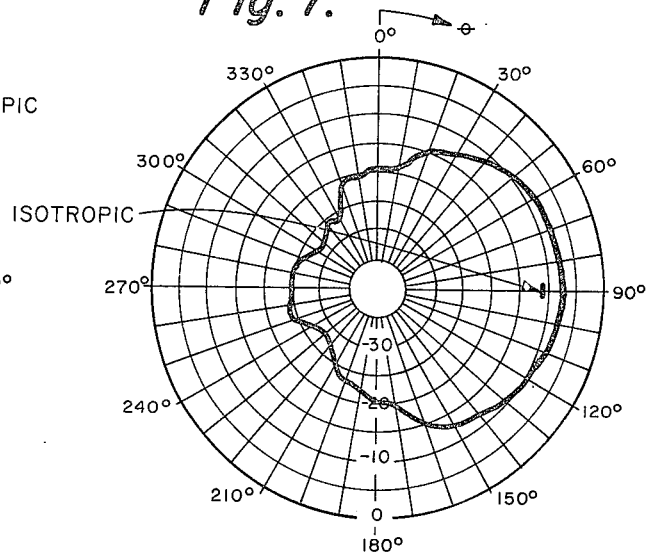
FIG. 7 shows the antenna radiation pattern (XZ—-Plane plot) for the square element antenna shown in FIGS. 1A and 1B.
Figure 8:
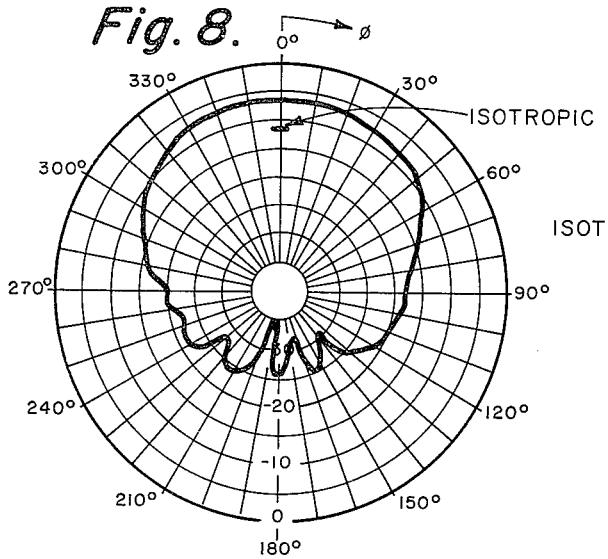
FIG. 8 shows the antenna radiation pattern (XY-Plane plot) for the rectangular element antenna shown in FIGS. 2A and 2B.
Figure 9:
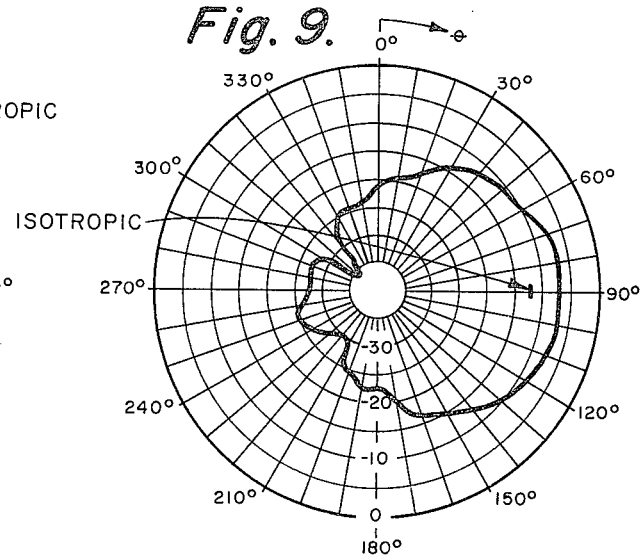
FIG. 9 shows the antenna radiation pattern (XZ-Plane plot) for the rectangular element antenna shown in FIGS. 2A and 2B.

FIGS. 6 and 7 show antenna radiation patterns for the square element of FIGS. 1A and 1B. FIGS. 8 and 9 show similar patterns for the rectangular element of FIGS. 2A and 2B. Only E-plane (XY-plane) plots and H-plane (XZ-plane) plots are shown. Cross-polarization energy was minimal and is therefore not included. The E-plane plot is the measurement made in the plane parallel to the E field (i.e., polarization field). The H-plane plot is the measurement made normal to the E field. The H-plane plots show that the rectangular element has a narrower beam width than the square element. Note that the beam width narrowing effects are due to ground plane effects.

Since the design equations for this type of antenna are new, pertinent design equations that are sufficient to characterize this type of antenna are therefore presented.

DESIGN EQUATIONS

To a system designer, the properties of an antenna most often required are the input impedance, gain, bandwidth, efficiency, polarization, and radiation pattern. The antenna designer needs to know the above-mentioned properties and also the antenna element dimension as a function of frequency.

Figure 10:
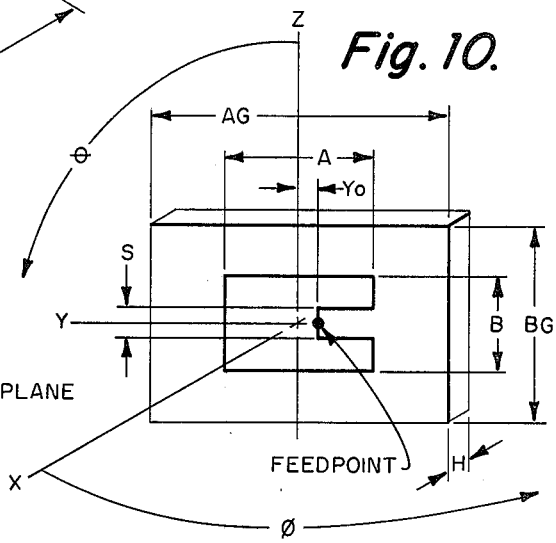
FIG. 10 illustrates the alignment coordinate system used for the notch fed electric microstrip dipole antenna.

The coordinate system used and the alignment of the antenna element within this coordinate system are shown in FIG. 10. The coordinate system is in accordance with the IRIG Standards and the alignment of the antenna element was made to coincide with the actual antenna patterns that were shown earlier. The B dimension is the width of the antenna element. The A dimension is the length of the antenna element. The H dimension is the height of the antenna element above the ground plane and also the thickness of the dielectric. The AG dimension and the BG dimension are the length and the width of the ground plane, respectively. The $y_o$ dimension is the location of the feed point measured from the center of the antenna element. The S dimension is the width of the notch. The angles $\theta$ and $\phi$ are measured per IRIG Standards. The above parameters are measured in inches and degrees.

Antenna Element Dimension

The equation for determining the length of the antenna element is given by $$A = [1.18 \times 10^{10} - F \times 4 \times H \times \sqrt{\epsilon}]/[2 \times F \times \sqrt{1 + 0.61 \times (\epsilon - 1) \times (B - S/H)^{0.1155}}] \quad (1)$$

where $x$ — indicates multiplication $F$ = center frequency (Hz)

$\epsilon$ = the dielectric constant of the substrate (no units).

In the above equation, the term (B-S) is referred to as the effective width of the element. As mentioned earlier, a greater bandwidth is observed when using a wider B dimension. For a wider bandwidth, it would be best to maintain a narrow notch dimension.

The main purpose of the notch feed system is to interconnect an array of elements at the elements optimum feed point using microstrip transmission lines. Tests have shown that a notch width equal to twice the microstrip transmission line width has very little effect on the antenna properties.

In most practical applications, B, F, H and $\epsilon$ are usually given. However, it is sometimes desirable to specify B as a function of A as in a square element. As seen from equation (1), a closed form solution is not possible for the square element. However, numerical solution can be accomplished by using Newton's Method of successive approximation (see U.S. National Bureau of Standards, Handbook Mathematical Functions, Applied Mathematics Series 55, Washington, D.C., GPO, Nov. 1964) for solving equation (1) in terms of B when B is a function of A. Equation (1) is obtained by fitting curves to Sobol's equation (Sobol, H., "Extending IC Technology to Microwave Equipment," ELECTRONICS, Vol. 40, *No.* 6 (20 Mar 1967), pp. 112–124). The modification was needed to account for end effects and also the effects of the notch when the microstrip transmission line is used as an antenna element. Sobol obtained his equation by fitting curves to Wheeler's conformal mapping analysis (Wheeler, H., "Transmission Line Properties of Parallel Strips Separated by a Dielectric Sheet," IEEE TRANSACTIONS, Microwave Theory Technician, Vol. MTT-13, No. 2, Mar 1965, pp. 172–185).

Radiation Pattern

The radiation patterns for the $E_\theta$ field and the $E_\phi$ field are usually power patterns, i.e., $|E_\theta|^2$ and $|E_\phi|^2$, respectively.

The electric field for the notch fed electric microstrip dipole is given by $$E_\theta = \frac{jI_m Z_o e^{-jkr}}{2\lambda r}[U \times \cos\phi + T \times \sin\theta] \quad (2)$$

and $$E_\phi = \frac{jI_m Z_o e^{-jkr}}{2\lambda r}[U \times \sin\phi \cos\theta] \quad (3)$$

where $U = (U2 - U3)/U5$ $T = (T3 - T4/T8$ $U2 = P \sin(A \times P/2) \cos(K \times A \times \sin\theta \sin\phi/2)$ $U3 = k \sin\theta \sin\phi \cos(A \times P/2) \sin(k \times A \times \sin\theta \sin\phi/2)$ $U5 = (P^2 - k^2 \sin^2\theta \sin^2\phi)$ $T3 = P \sin(P \times B/2) \cos(k \times B \times \cos\theta/2)$ $T4 = k \cos\theta \cos(P \times B/2) \sin(k \times B \times \cos\theta/2)$ $T8 = (P^2 - k^2 \cos^2\theta)$ $\lambda$ = free space wave length (inches)

$\lambda_g$ = waveguide wavelength (inches)

$j = (\sqrt{-1})$ $I_m$ = maximum current (amps)

$P = 2\pi/\lambda_g$, $k = 2\pi/\lambda$ $e$ = base of the natural log $r$ = the range between the antenna and an arbitrary point in space (inches)

$Z_o$ = characteristic impedance of the element (ohms)

and $Z_o$ is given by $$Z_o = \frac{3.77 \times H}{\sqrt{\epsilon} \times (B-S) \times [1 + 1.735(\epsilon^{-0.0724})(H/B-S)^{0.836}]}$$

Therefore $$|E_\phi|^2 = \frac{I_m^2 Z_o^2}{4\lambda^2 r^2}[U \times \cos\phi + T \times \sin\theta]^2 \quad (4)$$

and $$|E_\theta|^2 = \frac{I_m^2 Z_o^2}{4\lambda^2 r^2}[U \times \sin\phi \cos\theta]^2 \quad (5)$$

Since the gain of the antenna will be determined later, only relative power amplitude as a function of the aspect angles is necessary. Therefore, the above equations may be written as $$|E_\phi|^2 = \text{Const} \times [U \times \cos\phi + T \times \sin\theta]^2 \quad (6)$$

and $$|E_\theta|^2 = \text{Const} \times [U \times \sin\phi \cos\theta]^2 \quad (7)$$

The above equations for the radiation patterns are approximate since they do not account for the ground plane effects. Instead, it is assumed that the energy emanates from the center and radiates into a hemisphere only. This assumption, although oversimplified, facilitates the calculation of the remaining properties of the antenna. However, a more accurate computation of the radiation pattern can be made.

Polarization

The polarization of the notch fed microstrip dipole antenna is linear along the Y axis when the B dimension is less than the A dimension and also when the feed point is located dead center in the B dimension. If the feed point is not located dead center, cross polarization can occur.

Efficiency

Calculation of the efficiency entails calculating several other properties of the antenna. To begin with, the time average Poynting Vector is given by $$P_{av} = R_e(\overline{E} \times \overline{H}^*)/2 = (|E_\theta|^2 + |E_\phi|^2)/(2 \times Z_o) \quad (8)$$

where

* indicates the complex conjugate when used in the exponent $R_e$ means the real part and $X$ indicates the vector cross product.

$$P_{av} = \frac{Z_o I_m^2}{8\lambda^2 r^2}[U^2 \times \cos^2\phi + 2 \times T \times U \times \sin\theta\cos\phi + T^2 \times \sin^2\theta + U^2 \times \sin^2\phi\cos^2\theta] \quad (9)$$

The radiation intensity, K, is the power per unit solid angle radiated in a given direction and is given by $$K = r^2 \times P_{av} \quad (10)$$

The radiated power, W, is given by $$W = \int_O^{\pi} \int_{-\frac{\pi}{2}}^{\frac{\pi}{2}} K \times \sin\theta \, d\theta \, d\phi \quad (11)$$

The radiation resistance, $R_a$, is given by $$R_a = W/I_{eff}^2 \quad (12)$$

where $$I_{eff} = I_m/\sqrt{2} \quad (13)$$

therefore $$R_a = 2 \times W/I_m^2 \quad (14)$$

$$R_a = \frac{Z_o}{4 \times \lambda^2} \int_O^{\pi} \int_{-\frac{\pi}{2}}^{\frac{\pi}{2}} [U^2 \times \cos^2\phi + 2 \times T \times U \times \sin\theta\cos\phi + T^2 \times \sin^2\theta + U^2 \times \sin^2\phi\cos^2\theta] \sin\theta \, d\theta \, d\phi \quad (15)$$

Numerical integration of the above equation can be easily accomplished using Simpson's Rule. The efficiency of the antenna can be determined from the ratio of the Q (quality factor) due to the radiation resistance and the Q due to all the losses in the microstrip circuit. The Q due to the radiation resistance, $Q_R$, is given by $$Q_R = (\omega \times L \times A)/(2 \times R_a)$$

where $\omega = 2\pi F$ and $L$ is the inductance of a parallel-plane transmission line and can be found by using Maxwell's Emf equation, where it can be shown that $$L = Z_o/(F \times \lambda_g)$$

and $$\lambda_g \approx 2 \times A + (4 \times H/\sqrt{\epsilon})$$

The Q due to the radiation resistance, $Q_R$, is therefore given by $$Q_R = (\pi \times Z_o \times A)/(\lambda_g \times R_a)$$

The Q due to the copper losses, $Q_c$, is similarly determined.

$$Q_c = (\omega \times L \times A)/(2 \times R_c)$$

where $R_c$ is the equivalent internal resistance of the conductor. Since the ground plane and the element are made of copper, the total internal resistance is twice $R_c$. $R_c$ is given by $$R_c = (R_s \times A/B) \text{ (ohm)}$$

where $R_s$ is the surface resistivity and is given by $$R_s = \sqrt{(\pi \times F \times \mu)/\sigma} \text{ (ohm)}$$

where $\sigma$ is the conductivity in mho/in. for copper and $\mu$ is the permeability in henry/in. $\sigma$ and $\mu$ are given by $$\sigma = 0.147 \times 10^7, \mu = 0.0319 \times 10^{-6}$$

therefore $$Q_c = (\pi \times Z_o \times B)/(\lambda_g \times R_s)$$

The loss due to the dielectric is usually specified as the loss tangent, $\delta$. The Q, resulting from this loss, is given by $$Q_D = 1/\delta$$

The total Q of the microstrip antenna is given by $$Q_T = \frac{1}{\frac{1}{Q_R} + \frac{1}{Q_c} + \frac{1}{Q_D}}$$

The efficiency of the microstrip antenna is given by $$\text{eff} = Q_T/Q_R$$

Bandwidth

The bandwidth of the microstrip antenna at the half power point is given by $$\Delta f = F/Q_T$$

The foregoing calculations of Q hold if the height, H, of the element above the ground plane is a small part of a waveguide wavelength, $\lambda_g$, where the waveguide wavelength is given by $$\lambda_g \approx 2 \times A + (4 \times H/\sqrt{\epsilon})$$

If H is a significant part of $\lambda_g$, a second mode of radiation known as the monopole mode begins to add to the microstrip mode of radiation. This additional radiation is not undesirable but changes the values of the different antenna parameters.

Gain

The directive gain is usually defined (H. Jasik, ed., Antenna, Engineering Handbook, New York McGraw-Hill Book Co., Inc., 1961, p. 3) as the ratio of the maximum radiation intensity in a given direction to the total power radiated per $4\pi$ steradians and is given by $$D = K_{max}/(W/4\pi)$$

The maximum value of radiation intensity, k, occurs when $0 = 90°$ and $\phi = 0°$. Evaluating K at these values of $\theta$ and $\phi$, we have $$K \Big|_{\substack{\theta = 90° \\ \phi = 0°}} = K_{max}$$

$$K_{max} = \frac{Z_o I_m^2}{8\lambda^2 P^2}[\sin(AP/2) + \sin(BP/2]^2$$

since $$W = (R_a \times I_m^2)/2$$

$$D = \frac{Z_o \times \pi}{R_a \times \lambda^2 \times P^2}[\sin(AP/2) + \sin(BP/2]^2$$

and for $A = B$ $$D = (4 \times Z_o \times A^2)/(R_a \times \lambda^2 \times \pi)$$

Typical calculated directive gains are 5.7 db. The gain of the antenna is given by $$G = D \times \text{efficiency}$$

Input Impedance

To determine the input impedance at any point along the notch fed microstrip dipole antenna, the current distribution may be assumed to be sinusoidal. Furthermore, at resonance the input reactance at that point is zero. Therefore, the input resistance is given by $$R_{in} = \frac{2 \times Z_o^2 \times \sin^2(2\pi\, y_o/\lambda_g)}{R_t}$$

Where $R_t$ is the equivalent resistance due to the radiation resistance plus the total internal resistance or $$R_t = R_a + 2R_r$$

The equivalent resistance due to the dielectric losses may be neglected.

The foregoing equations have been developed to explain the performance of the stripline antenna radiators discussed herein and are considered basic and of great importance to the design of antennas in the future.

Typical antennas have been built using the above equations and the calculated results are in good agreement with test results.

Figure 11:
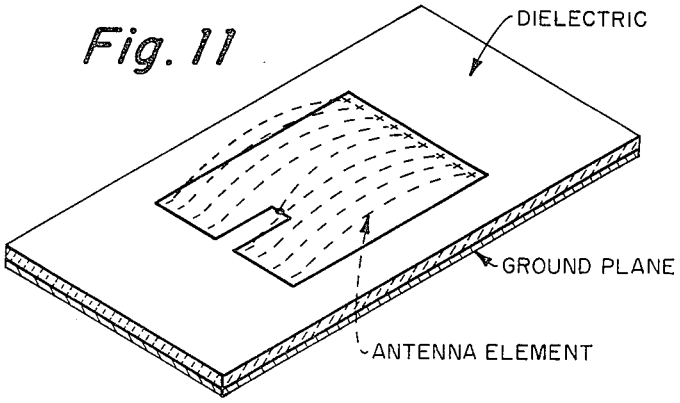
FIG. 11 illustrates the general configuration of the near field radiation when fed along the centerline of the antenna.

The near field radiation configuration, when the antenna is fed in the notch at the center of the width of the antenna and where the length of the element is approximately ½ the waveguide wavelength ($\lambda_g$), is shown in FIG. 11. If the feed point is moved off the center of the width, the field configuration will change to include cross-polarization radiation.

Figure 12:
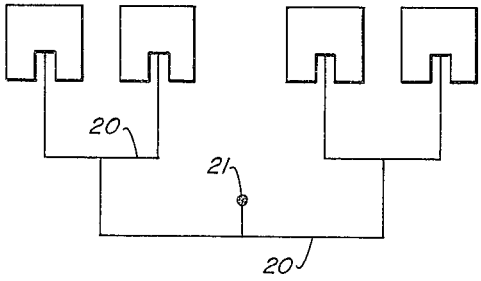
FIG. 12 shows a general arraying configuration using a plurality of notch fed antenna elements.

A plurality of microstrip antenna elements can be arrayed on a dielectric substrate 14 by using microstrip transmission line 20, such as diagrammatically illustrated in FIG. 12, and fed from a single coaxial-to-microstrip connector at 21.

The advantages of the notch fed electric microstrip dipole antenna are that it can be fed at the optimum feedpoint, can easily be arrayed with microstrip transmission line, and the element width can be made as wide as the element length, thus permitting wider bandwidth without incurring cross-polarization fields.

Obviously many modifications and variations of the present invention are possible in light of the above teachings. It is therefore to be understood that within the scope of the appended claims the invention may be practiced otherwise than as specifically described.

I claim:

1. A notch fed electric microstrip dipole antenna having low physical profile and conformal arraying capability, comprising:

a. a thin ground plane conductor;

b. a thin rectangular radiation element having a notch extending into said element from one end thereof along the centerline of the element length, said element being spaced from said ground plane;

c. said radiating element being electrically separated from said ground plane by a dielectric substrate;

d. said radiating element having an optimum feed point located along the centerline of the length thereof at the inner end of said notch;

e. said radiating element being fed from a coaxial-to-microstrip adapter, the center pin of said adapter extending through said ground plane and dielectric substrate to the plane of said radiating element;

f. the length of said radiating element determining the resonant frequency of said antenna;

g. the antenna input impedance being variable to match most practical impedances as said feed point is moved along said centerline without affecting the antenna radiation pattern;

h. the antenna bandwidth being variable with the width of the radiating element and the spacing between said radiating element and said ground plane, the width of said notch being a factor as to the effective width of said element, said spacing between the radiating element and the ground plane having somewhat greater effect on the bandwidth than the element width.

2. An antenna as in claim 1 wherein the ground plane conductor extends at least one wavelength beyond each edge of the element to minimize any possible backlobe radiation.

3. An antenna as in claim 1 wherein said thin rectangular radiation element is in the form of a square, said square element being the limit as to how wide the element can be without exciting higher order modes of radiation.

4. An antenna as in claim 1 wherein a plurality of said radiating elements are arrayed with microstrip transmission lines to provide a near isotropic radiation pattern.

5. An antenna as in claim 1 wherein the length of said radiating element is approximately ½ wavelength.

6. An antenna as in claim 1 wherein said antenna element feed point is connected directly to said adapter center pin.

7. An antenna as in claim 1 wherein said antenna element optimum feed point is connected to said adpater center pin by means of microstrip transmission line.

8. An antenna as in claim 1 wherein said thin rectangular radiating element is formed on one surface of said dielectric substrate.

9. An antenna as in claim 1 wherein the length of the antenna radiating element is determined by the equation:

$$A = [1.18 \times 10^{10} - F \times 4 \times H \times \sqrt{\epsilon}]/[2 \times F \times \sqrt{1 + 0.61 \times (\epsilon - 1) \times (B-S/H)^{0.1155}}]$$

where

A is the length to be determined

F = the center frequency (Hz)

B = the width of the antenna element

H = the thickness of the dielectric $\epsilon$ = the dielectric constant of the substrate S = the width of the notch B-S = the effective width of the antenna element.

10. An antenna as in claim 1 wherein the radiation patterns are power patterns, $|E_\theta|^2$ and $|E_\phi|^2$, polarization field E and the field normal to the polarization field E, and are given by the equations:

$$|E_\phi|^2 = \frac{I_m^2 Z_o^2}{4\lambda^2 r^2}[U \times \cos\phi + T \times \sin\theta]^2$$

and $$|E_\theta|^2 = \frac{I_m^2 Z_o^2}{4\lambda^2 r^2}[U \times \sin\phi \cos\theta]^2$$

where $U = (U2 - U3)/U5$ $T = (T3 - T4/T8$ $U2\ 32\ P \sin (A \times P/2) \cos (k \times A \times \sin\theta \sin\phi/2)$ $U3 = k \sin\theta \sin\phi \cos (A \times P/2) \sin (k \times A \times \sin\theta \sin\phi/2)$ $U5 = (P^2 - k^2 \sin^2\theta \sin^2\phi)$ $T3 = P \sin (P \times B/2) \cos (k \times B \times \cos\theta/2)$ $T4 = k \cos\theta \cos (P \times B/2) \sin (k \times B \times \cos\theta/2)$ $T8 = (P^2 - K^2 \cos^2\theta)$ $I_m$ = maximum current (amps)

$P = 2\pi/\lambda_g$, $k = 2\pi/\lambda$ $\lambda$ = free space wave length (inches)

$\lambda_g$ = waveguide wavelength (inches)

and $\lambda_g \approx 2 \times A + (4 \times H/\sqrt{\epsilon})$ $r$ = the range between the antenna and an arbitrary point in space (inches)

$Z_o$ = characteristic impedance of the element (ohms)

and $Z_o$ is given by $$Z_o = \frac{377 \times H}{\sqrt{\epsilon} \times (B-S) \times [1 + 1.735\ (\epsilon^{-0.0724})\ (H/B-S)^{0.836}}$$

$H$ = the thickness of the dielectric $B$ = the width of the antenna element $S$ = the width of the notch $\epsilon$ = the dielectric constant of the substrate (no units).

11. An antenna as in claim 1 wherein the minimum width of said radiating element is determined by the equivalent internal resistance of the conductor plus any loss due the dielectric.

12. An antenna as in claim 1 wherein the input impedance, $R_{in}$, is given by the equation $$R_{in} = \frac{2 \times Z_o^2 \times \sin^2 (2\pi\ y_o/\lambda_g)}{R_a + 2R_c}$$

where $R_a$ the radiation resistance $2R_c$ = the total internal resistance $Z_o$ = characteristic impedance of the element, and $y_o$ = distance of feed point from the center of the element.

* * * * *

UNITED STATES PATENT OFFICE

CERTIFICATE OF CORRECTION

Patent No. 3,947,850 Dated March 30, 1967

Inventor(s) Cyril M. Kaloi

It is certified that error appears in the above-identified patent and that said Letters Patent are hereby corrected as shown below:

Column 5, line 26, and Claim 9, column 11, line 21, the equation for A should read $$A = \frac{\left[1.18 \times 10^{10} - F \times 4 \times H \times \sqrt{\epsilon}\right]}{\left[2 \times F \times \sqrt{1 + 0.61 \times (\epsilon - 1) \times \left(\frac{B-S}{H}\right)^{0.1155}}\right]}$$

Column 5, line 67, "Technician" should read -- Technique --;

Column 6, line 20, and Claim 10, column 12, line 2, the equation for T should read -- T = (T3 - T4)/T8 --;

Column 6, line 21, and Claim 10, column 12, line 3, should read

-- U2 = P sin (A × P/2) cos (k × A × sin θ sin φ/2 ) --;

Column 6, line 40, and Claim 10, column 12, line 22, the equation for $Z_o$ should read $$Z_o = \frac{377 \times H}{\sqrt{\epsilon} \times (B-S) \times \left[1 + 1.735\ (\epsilon^{-0.0724})\left(\frac{H}{B-S}\right)^{0.836}\right]}$$

Column 9, line 20, "k" should read -- K --;

Column 12, line 9, should read -- T8 = $(P^2 - k^2 \cos^2 \theta)$ --;

Signed and Sealed this

Thirteenth Day of July 1976

[SEAL]

*Attest:*

RUTH C. MASON
*Attesting Officer*

C. MARSHALL DANN
*Commissioner of Patents and Trademarks*